United States Patent [19]

Heller et al.

[11] 4,453,465

[45] Jun. 12, 1984

[54] WEB TURNING ROD HAVING AIR FLOW CONTROL MEANS

[75] Inventors: Albert Heller, Pestenacker; Hubert Birkmair, Friedberg; Hermann Grauberger, Augsburg, all of Fed. Rep. of Germany

[73] Assignee: M.A.N.-Roland Druckmaschinen Aktiengesellschaft, Offenbach am Main, Fed. Rep. of Germany

[21] Appl. No.: 486,399

[22] Filed: Apr. 19, 1983

[30] Foreign Application Priority Data

Apr. 24, 1982 [DE] Fed. Rep. of Germany ..... 3215472

[51] Int. Cl.[3] ..... B65H 17/32; B41F 13/06

[52] U.S. Cl. ..... 101/228; 226/97; 226/197

[58] Field of Search ..... 101/228, 219, 178; 226/7, 97, 197, 198, 199; 34/156

[56] References Cited

U.S. PATENT DOCUMENTS 1,630,713 5/1927 Meyer ..... 226/197 X
3,599,851 8/1971 Hedlund ..... 226/197 X
3,744,693 7/1973 Greiner ..... 226/97
4,043,495 8/1977 Sander ..... 226/197

FOREIGN PATENT DOCUMENTS 2026355 11/1971 Fed. Rep. of Germany .

*Primary Examiner*—J. Reed Fisher
*Attorney, Agent, or Firm*—Frishauf, Holtz, Goodman & Woodward

[57] ABSTRACT

To permit adjustment of air flow through air exchange openings (7,8,9;25,29) of a hollow outer turning rod tube (11,23,30), a plurality of inner tube elements (12,24,32) are axially located within the outer tube, and formed with part-circumferentially extending slits (13) in alignment with the air exchange openings. The inner tube elements can be, slectively, rotated for alignment of the slit (13) with the air exchange openings, or blocking of the air exchange openings by solid portions of the tube elements. Rotation can be effected by adjustment knobs (FIGS. 1–3: 17) having an inner gearing (16) engaging a side gearing (15) on the tube elements; by finger adjustment (FIG. 4) or by positioning wheels (FIG. 5: 34) in engagement with a roughened, stippled, ribbed or corrugated surface portion or region of the inner tube elements.

11 Claims, 5 Drawing Figures

WEB TURNING ROD HAVING AIR FLOW CONTROL MEANS

Reference to Related Publication: German Published Patent Application DE-AS No. 20 26 355.

The present invention relates to a web turning rod, and more particularly to a web turning rod used, for example, to change the direction of paper webs received from, or being delivered to a printing machine, and especially to such turning rods which include air control elements to control the flow of differentially pressurized, typically compressed air from the interior of the turning rod to form an air cushion for the web being passed therearound.

BACKGROUND

The referenced German published Patent Application DE-AS No. 20 26 355 describes a turning rod, particularly adapted to change the direction of paper webs in which the paper web is passed around the turning rod, while the turning rod is washed with air flow. To provide for the air flow, the turning rod is formed with air exit openings, and constructed in form of a hollow tube, supplied with compressed air from a compressed air source. Consequently, the paper web which is passed around the turning rod can be floated thereabout, and thus abrasive contact with the truning rod or bar is prevented. The referenced German application describes cover sheets to cover selected air exit openings on the turning rod.

It has been found that placing cover openings, or tube sections about a turning rod causes damage to the material which is to be turned, or wrapped thereabout, and such elements are particularly undesirable if the web being turned or passed over the turning rod is paper. Contact with a turning rod cannot be prevented and the web is subject to damage particularly if the turning rod should not be perfectly aligned with respect to the web, or improperly adjusted. Personal judgement of operators, thus, is frequently required to permit operation of such a turning rod without difficulty. Individual coverage of any one of the air exit openings which may not be needed is not possible by this system; only air exit openings located at end or edge portions can be effectively controlled.

THE INVENTION

It is an object to provide a turning rod in which air exit openings can be individually controlled to permit exit of air, or to block the openings, and in which the outer surface of the turning rod is smooth so that contact of a paper web therewith will not cause damage to the web.

Briefly, the turning rod is formed as a hollow tube having an air supply under pressure different from atmospheric, and formed with air exchange openings. The tube may, for example, be supplied with compressed air. To close off selected ones of the air exchange openings, a plurality of inner tube elements are located within the hollow tube, accessible from the outside of the hollow tube through openings formed therein. The plurality of tube elements each are formed with air exchange openings which can be selectively aligned with the air exchange openings in the outer tube by rotating the inner tube elements. Rotation can be accomplished by engagement of the inner tube elements through adjustment control openings formed in the outer one. These adjustment control openings may be large enough to, for example, permit rotating the inner tube elements by engagement with a finger of an operator—for example on a knurled, or ribbed, or corrugated surface; alternatively, mechanical positioning elements such as adjustment knobs with gears thereon engaging a gearing on the inner tube elements, or adjustment wheels having ribbed, or gear circumference portions and engaging similarly ribbed portions on the tube elements can be provided. Remote control is readily possible, for example, by connecting the respective adjustment knobs or gear wheels either to small positioning servomotors or, for example, to connect them by means of rotary transmission Bowden cables to an externally readily accessible control position. Remote control may be particularly desirable in those instances where the adjustment elements are hidden by the paper webs which are passed around the turning bars.

DRAWINGS

DETAILED DESCRIPTION

Figure 1:
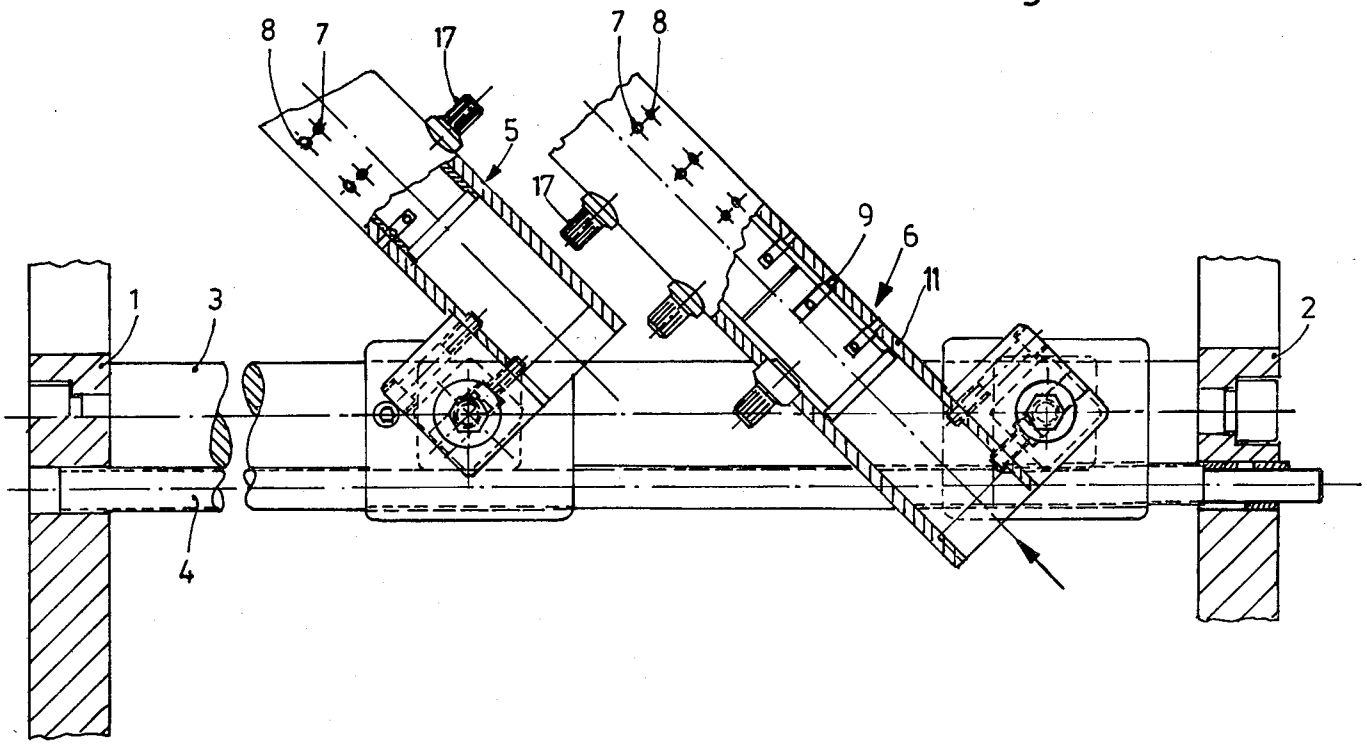
FIG. 1 is a fragmentary side view, partly in section, of two turning rods retained between sidewalls of a paper web turning apparatus.

Two sidewalls 1, 2 of a printing machine, or other web handling machine support between themselves a transverse rod 3. Two turning rods 5, 6 are slidably located on the transverse rod 3, positionable at selected positions by a spindle 4, which is threaded, and passed through a suitably threaded sleeve slidable on the transverse rod 3. The turning rods 5, 6 are tubular elements which are formed with air exit openings 7, 8, 9, positioned, as is customary, in the region of a receiving paper web, and a leaving paper web. These air exit openings, thus, are offset on the respective rods 5, 6 by about 180°, for example, and are located aligned rows. This part of the construction of the turning rod may be in accordance with any well-known turning rod, or turning bar arrangement, as is customary for example in connection with printing machines.

The turning rod 6 is shown to greatly enlarge scale in FIG. 2, and the present invention will be described in connection therewith, and particularly with control of air being emitted from air exit openings 7, 8, 9.

Figure 2:
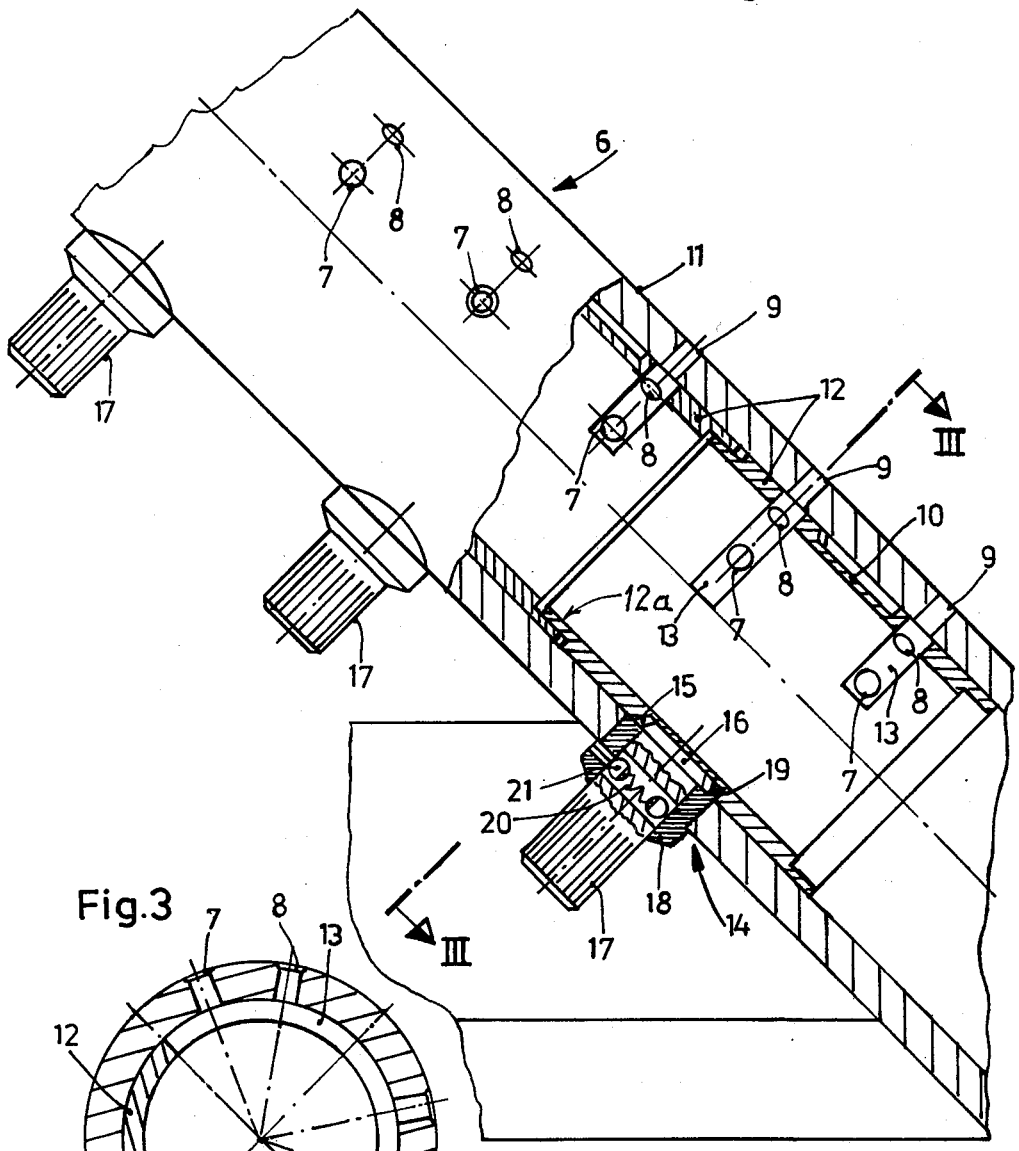
FIG. 2 is a partial sectional view through one turning rod, to an enlarged scale.

The turning rod 6—FIGS. 1 and 2—has an outer tubular element 11, supplied axially with air under pressure different from atmospheric, for example compressed air. In the example shown in FIG. 2, a plurality of inner tube elements 12 is inserted in the outer tube element 11. The length of the tube elements 12 is just a little longer than the distance between two adjacent air exit openings 9 in one of the rows of air exit openings 7, 8, 9. Thus, one tubular element 12 is capable of either covering, or aligning with two air exit openings 9, looked at in axial direction. The inner tube elements 12 are formed with depressions or reliefs 10, extending in circumferential direction. The tube elements 12, at their matching or engaging surfaces may be formed with interengaging Z-shaped surfaces, to provide a tight fit, while leaving a slight axial gap therebetween, as illustrated at 12*a*. The slight distance between the tubes is provided to permit axial expansion of the tube in case of heating thereof. The specific interlocking arrangement of the tube elements 12, as shown at 12*a*, provides for sealing of the compressed air within the inner tube elements and insuring stability of the respective elements with respect to each other, in rotated, and longitudinal position.

The tube elements 12 are formed with through-openings extending in circumferential direction. These through openings may, for example, be in the form of circumferentially extending slits 13. The alignment position of the slit 13 with respect to the air exit openings 7, 8, 9 can be so adjusted that, upon rotating the respective tube elements 12, the inner tube element will either permit air to pass through the slits 13 and out the respecitve air openings, or block one or all of the air openings.

As well-known, air-washed turning rods usually receive compressed air, for example by an axial compressed air connection (not shown) in order to improve guidance of the web to be deflected by the turning rod, the compressed air being emitted from the respective air exit openings. By respectively circumferentially changing the position of the inner tube elements 12, the slits 13 will either block, or permit passage of the compressed air towards a web to be passed around the rod and thus greatly affect the operating characteristic of the turning rod. Rotating the inner tubular elements 12, thus, influences the operation of the respective air exit openings 7, 8, 9.

Adjustment in circumferential direction of the inner elements 12 can be carried out in various ways. The outer tubular element 11 is formed with suitable position adjustment openings 14 therethrough to permit access to the inner tubular elements for rotating the inner tubular elements. The axial guidance of the inner tubular elements can be also insured by structural features in combination therewith.

In accordance with a feature of the invention, the inner tubular elements 12 are formed with gearing 15 on at least one lateral side, or edge of the recess 10. A conical element 16, formed with external gearing engages within the recess 10, and is in gearing engagement with the gearing 15 on the edge of the recess 10. The conical element 16 is connected to an adjustment knob 17 located externally of the outer tube 11. Upon rotation of the knob 17, thus, the inner tubular elements 12 are positioned in a selected rotary location so that, selectively, exit openings, or entire rows of exit openings can be blocked, or aligned with the slits 13. Adjustment of the knob 17 can be carried out manually, individually; alternatively, the knob 17 can be coupled to a suitable remote-controlled positioning motor, or, for example, can be coupled to flexible shafts for control from an operating position. One or more of the openings, for examples opening 17 may be supplied with suitable limit stops. For example, the opening 17 may have a slit tube element clamped therein which provides for limiting the rotation of the inner tubular elements 12. Individual indication of the coverage of the slits 13 with respect to the openings 7–9 is thus provided, and facilitated. Use of a split-ring, or split-sleeve has the advantage that a through-opening of one of the openings of the rows 7–9 will always be left open, since the sleeve can project inwardly sufficiently to pass within the slit 13 and limit rotation of the respective tubular element 12.

The arrangement of FIGS. 1 and 2 has the additional advantage of simplicity of positioning of the adjustment knob 17. For example, a guide sleeve 18—see FIG. 2—is fitted into the opening 14 in the outer tube 11, and secured therein by an adhesive. The guide sleeve 18 is formed with a lower projection 19 which engages the recess or depression 10 of the inner tube element such that, in combination with the cone 16 engaging the gearing 15, the axial position of the respective tubular elements 12 is thereby determined. The projection 19, thus, can ride against a smooth side of the depression or recess 10, the cone 16 engaging the gearing 15 at the other side of the recess. Thus, axial positioning of the tubular element 12 is insured by the simple provision of a guide projection or surface 19 on the sleeve 18.

The specific postion of the slits 13 with respect to the openings 7, 8, 9 can, additionally, be determined by providing a spring-loaded ball 21 within the knob 17, engaging in suitably located depressions in the guide sleeve 18, the depressions matching the position of the sleeve when one or more of the holes 7, 8, 9 are covered. Thus, a fixed position of the circumferential adjustment of the inner tubular elements 12 can be readily obtained, and permitting adjustment "by feel" manually, for example directly on the knob 17 or by means of a remote cable which can be coupled thereto, permanently or removably, for example by a square end element fitting into a suitable square recess in the knob 17.

Figure 4:
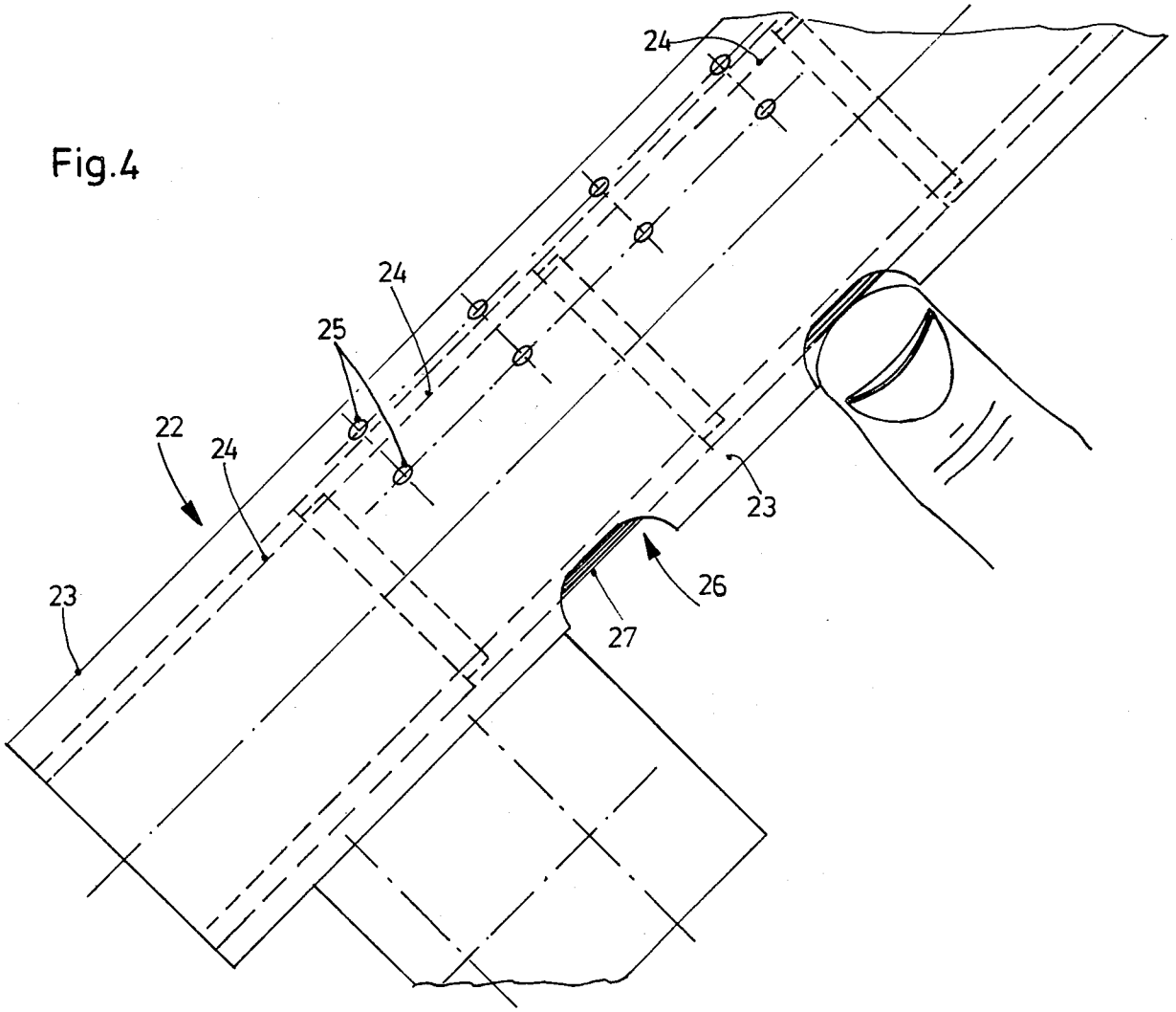
FIG. 4 is view similar to FIG. 2, and showing another embodiment.

If the knob-adjustment is not required, and the turning bars are accessible, a simple solution to adjustment of the inner tubes can be used as shown in FIG. 4. A customary turning bar 22, which includes an outer tube 23 has located therein a plurality of adjacent, axially positioned inner elements 24. The outer tube 23 is formed with plurality of air exit openings 25. In accordance with a preferred feature of the invention, the inner elements 24 are formed with engagement projections, or thumps, which may engage, for example, against one lateral surface of the openings 25, to provide a predetermined interlocking engagement at suitable positions.

The outer tubular element 23 is forms with openings 26, associated with each one of the inner elements 24. These openings are large enough to permit adjustment, by rotation, of the inner elements 24 manually, by engagement, for example, with an index finger of the operator, to provide for circumferential adjustment of the inner tube element 24. The rotary adjustment, then, either covers, or unblocks the respective air exit openings 25 in the outer tube 22. Preferably, the inner tubular elements 24 is formed with a knurled, or stippled, or otherwise roughened surface 27 in the region beneath the openings 26.

Figure 5:
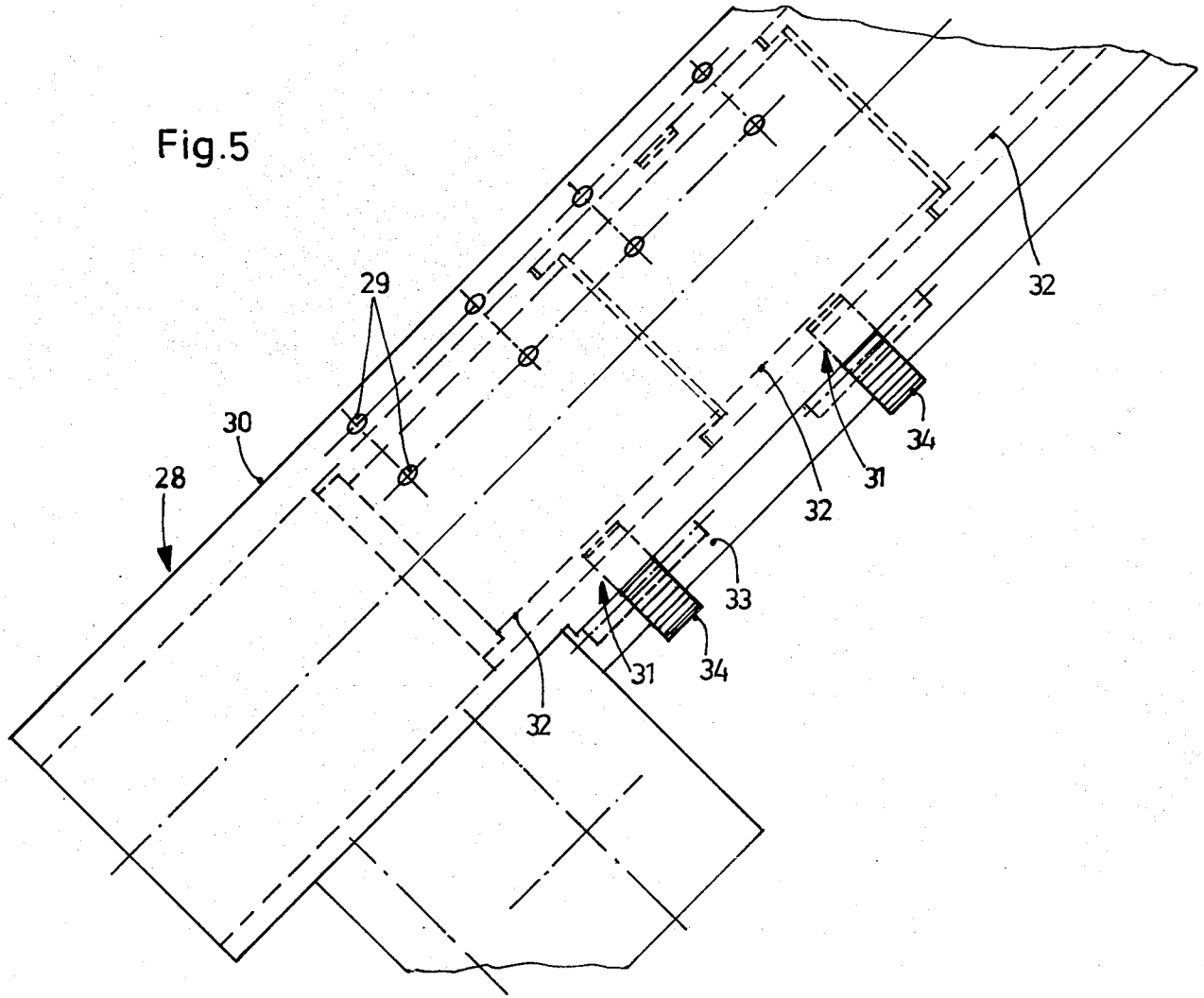
FIG. 5 is view similar to FIG. 2, and showing a third embodiment.

FIG. 5 illustrates an arrangement to adjust the inner tubular elements 32 located within an outer tube 30 of a turning rod 28. The tube 30 is formed with air exit openings 29. Each inner element 32 has associated therewith an opening 31 in the outer tube 30 through an adjustment wheel 34 can penetrate. The outer tube 30 has a holder 33 secured thereto, for example by welding or riviting, which guides and retains the positioning wheel 34. Engagement of the positioning 34 with the inner tubular element 32 is effected through the opening 31, and, for example, may be by frictional engagement, or by engagement with a ribbed, knurled surface portion of the inner tubular element 32 with a similarly ribbed or knurled, or gear-shaped surface portion on the adjustment wheel 34. Rotation of the adjustment wheel 34, then, again will either provide for air passage from the interior of the inner tubular element 32 through a suitable slit and the exit openings 29, or blocking of the exit openings by the respective inner tubular elements. The adjustment wheel 34 can be manually operated, directly or by remote control by a flexible shaft or by positioning motors, for example. The respective wheels 34 are, preferably, individually adjustable as shown.

Various changes and modifications may be made and features described in connection with any one of the embodiments may be used with any of the others, within the scope of the inventive concept.

We claim:

1. Web turning rod with controlled air flow openings, for deflecting the path of a web being passed thereover having an outer hollow tube (11, 23, 30) having air supplied thereto under pressure different from atmospheric, and formed with air exchange openings (7, 8,9; 25, 29);

and means for selectively covering the air exchange openings and thereby controlled air flow therethrough wherein, in accordance with the invention a plurality of air tube elements (12, 24, 32) are provided, located within the outer tube (11, 23, 30), said air tube elements being formed with air exchange openings (13) which are positioned at locations matching at least one of the air exchange openings (7,8, 9;25,29) in the outer tube;

and wherein the outer tube (11,23,30) is formed with additional openings (14,26,31) forming position adjustment openings for exposing a surface region of the respective tube elements of said plurality of tube elements to permit rotary positioning of said inner tube elements and, selectively, alignment of the air exchange openings (13) therein with the air exchange openings in the outer hollow tube.

2. Turning rod according to claim 1 wherein said surface region of the inner tube elements beneath the additional openings (14,26,31) of the outer hollow tube (11,23,30) are formed with rough surface.

3. Turning rod according to claim 2 wherein said rough surface has the surface characteristic of at least one of: knurled; stippled; corrugated; ribbed.

4. Turning rod according to claim 1 further comprising (FIG. 5) adjustment wheels (34) secured to the outer tube (30) and engaging through the additional openings (31) in the outer tube with the surface region of the respective tube elements to permit transfer of rotary movement of the positioning wheels to the respective tube elements for selective alignment of the air exchange openings (13) in the inner tube elements with the air exchange openings (29) in the outer hollow tube (30).

Figure 3:
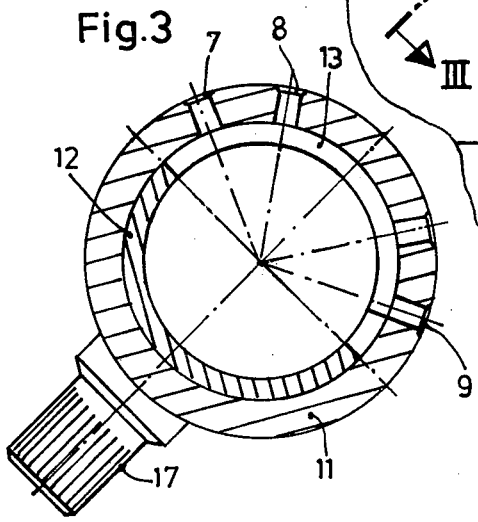
FIG. 3 is a sectional view along line III—III of FIG. 2.

5. Turning rod according to claim 1 wherein (FIGS. 1—3) the inner tube elements (12) are formed with a circumferential groove or recess (10);

a gearing (15) formed on an edge of the circumferential groove or recess;

and adjustment knob (17) having a gearing (16) projecting through the additional opening (14) in the outer tube (11).

6. Turning rod according to claim 5 further including a guide sleeve (18) secured to the outer tube (11), receiving said adjustment knob and maintaining said adjustment knob in position.

7. Turning rod according to claim 5 further comprising a guide surface projection (19) extending from the outer tube and engaging the side of the groove or recess which is free from said gearing (15) to provide for axial positioning of the respective tube element (12).

8. Turning rod according to claim 6 further including a locating projection (19) formed on the guide sleeve (18) and engaging the side of the groove or recess free from the gearing to provide a locating guide surface for axial guidance of the respective tube element (12).

9. Turning rod according to claim 1 including interengaging projection-and-recess means (10,19) formed in the outer tube (11,23,30) and in the inner tube elements (12,24,32) and providing for axial guidance of the tube elements within the outer tube.

10. Turning rod according to claim 1 wherein the plurality of inner tube elements are axially stacked within the outer hollow tube;

and means (10,19) are provided slightly spacing the inner tube elements from each other to permit relative axial movement of the outer tube and the inner tube elements upon differential heating.

11. Turning rod according to claim 10 wherein adjacent inner tube elements are formed with overlapping end portions to provide a low-leakage air path within the inner tube elements while permitting relative axial movement of the inner tube elements with respect to each other, and with respect to the outer tube.

* * * * *